US005762035A

United States Patent [19]

Schebitz

[11] Patent Number: 5,762,035

[45] Date of Patent: Jun. 9, 1998

[54] ELECTROMAGNETIC CYLINDER VALVE ACTUATOR HAVING A VALVE LASH ADJUSTER

[75] Inventor: Michael Schebitz, Eschweiler, Germany

[73] Assignee: FEV Motorentechnik GmbH & Co. KG, Aachen, Germany

[21] Appl. No.: 814,882

[22] Filed: Mar. 12, 1997

[30] Foreign Application Priority Data

Mar. 16, 1996 [DE] Germany ..... 296 04 946.8

[51] Int. Cl.[6] ..... F01L 9/04

[52] U.S. Cl. ..... 123/90.11

[58] Field of Search ..... 123/90.11, 90.1

[56] References Cited

U.S. PATENT DOCUMENTS

| | | | |
|---|---|---|---|
| 4,256,065 | 3/1981 | Hirt | 123/90.11 |
| 4,777,915 | 10/1988 | Bonvallet | 123/90.11 |
| 5,131,624 | 7/1992 | Kreuter et al. | 123/90.11 |
| 5,347,961 | 9/1994 | Buehrle, II et al. | 123/90.11 |
| 5,548,263 | 8/1996 | Bulgatz et al. | 123/90.11 |
| 5,611,303 | 3/1997 | Izuo | 123/90.11 |
| 5,636,601 | 6/1997 | Moriya et al. | 123/90.11 |

*Primary Examiner*—David A. Okonsky
*Attorney, Agent, or Firm*—Spencer & Frank

[57] ABSTRACT

An internal-combustion engine includes a cylinder head; a cylinder valve supported for reciprocating motion in the cylinder head to assume open and closed positions; and an electromagnetic actuator for operating the cylinder valve. The electromagnetic actuator includes a housing; and a first and a second electromagnet received in the housing and secured thereto at a fixed distance from one another. The first electromagnet has a first pole face and the second electromagnet has a second pole face oriented toward the first pole face. The actuator further has an armature positioned between the first and second pole faces for a reciprocating motion therebetween; return springs arranged for exerting oppositely oriented forces on the armature, whereby the armature executes reciprocating motion against a spring force; a connecting arrangement for coupling the armature to the stem of the cylinder valve; and a setting unit for displacing the housing relative to the cylinder valve.

11 Claims, 1 Drawing Sheet

ELECTROMAGNETIC CYLINDER VALVE ACTUATOR HAVING A VALVE LASH ADJUSTER

CROSS REFERENCE TO RELATED APPLICATION

This application claims the priority of German Application No. 296 04 946.8 filed Mar. 16, 1996, which is incorporated herein by reference.

BACKGROUND OF THE INVENTION

This invention relates to an electromagnetic actuator which is intended particularly to operate cylinder valves and which has a valve lash adjusting mechanism.

U.S. Pat. No. 4,777,915 discloses an electromagnetic actuator for a cylinder valve of a piston-type internal-combustion engine. The actuator has two superposed, spaced electromagnets, between the pole faces of which an armature is guided for reciprocating motion against the force of return springs. The armature is fixedly connected with the stem of the cylinder valve (intake or exhaust poppet valve). The upper electromagnet serves as a closing magnet whereas the lower electromagnetic serves as an opening magnet. Thus, by means of an alternating energization of the closing magnet and the opening magnet the cylinder valve may close or open. Because of temperature changes and/or wear, the conditions for valve opening and particularly those for valve closing vary and thus the preset valve stroke also changes. A piston-and-cylinder unit shifts the closing magnet based on the operational conditions and thus adjusts the valve lash. Such an arrangement, however, has the disadvantage that when the valve lash is adjusted, the stroke of the actuator, that is, the length of displacement of the armature between the two pole faces of the electromagnets also changes. Such a change, however, is not allowed to occur in case of a throttle-free load control of the internal-combustion engine because this would mean a change of the charge quantity in the cylinder as a function of temperature and time.

SUMMARY OF THE INVENTION

It is an object of the invention to provide an improved electromagnetic actuator of the above-outlined type which has a valve lash adjuster that has no effect on the motion geometry of the armature.

This object and others to become apparent as the specification progresses, are accomplished by the invention, according to which, briefly stated, the internal-combustion engine includes a cylinder head; a cylinder valve supported for reciprocating motion in the cylinder head to assume open and closed positions; and an electromagnetic actuator for operating the cylinder valve. The electromagnetic actuator includes a housing as well as first and second electromagnets received in the housing and secured thereto at a fixed distance from one another. The first electromagnet has a first pole face and the second electromagnet has a second pole face oriented toward the first pole face. The actuator further has an armature positioned between the first and second pole faces for a reciprocating motion therebetween; return springs arranged for exerting oppositely oriented forces on the armature, whereby the armature executes reciprocating motion against a spring force; a connecting arrangement for coupling the armature to the stem of the cylinder valve; and a setting unit for displacing the housing relative to the cylinder valve.

By virtue of the invention it is feasible to effect a compensation (adjustment) of a valve lash without changing the motion geometry of the armature and thus the stroke of the actuator. While in principle it is feasible to provide a mechanical construction as the lash setting means, according to a preferred feature of the invention the setting arrangement is constituted by at least one piston-and-cylinder unit which is in communication with a fluid pressure source. In this manner it is feasible to cause a "follow-up motion" of the housing (and thus the two electromagnets affixed thereto) corresponding to the changes in temperature and wear conditions, whereby, for example, a valve chatter is avoided.

According to a further advantageous feature of the invention, the housing is supported in a guide for displacements parallel to the direction of valve reciprocation. Such an arrangement permits a combination of the essential components of the actuator, that is, both electromagnets, the armature having its own guide rod and at least one resetting spring into a compact structural unit enclosed by the shiftable housing. Such a unit is reliably held by the guide and is movable only when valve lash compensation is to take place.

According to a further advantageous feature of the invention, the guide is arranged on that end face of the housing which is oriented towards the cylinder valve. According to a further feature of this arrangement, the guide has a pressing part connected with the housing and further has a holding part connected with the cylinder head. Between the pressing part and the holding part at least one piston-and-cylinder unit is arranged. Apart from the compact construction made possible by such an arrangement, a simplification of the pressurized fluid supply is achieved by virtue of the arrangement immediately at the cylinder head.

In accordance with another advantageous feature of the invention, the piston-and-cylinder unit is supported in a receiving bore of the holding part. The arrangement may be such that the piston of the unit is fixedly attached to the holding part while the cylinder of the unit is guided for displacement in the receiving bore and exerts a force on the pressing part. This arrangement has further the advantage that mass-manufactured components generally available for other purposes in the vehicle making industry, may be used as the piston-and-cylinder unit.

According to another advantageous feature of the invention, the piston-and-cylinder unit is coupled to a fluid pressure supply system of the engine. This feature has the advantage that upon starting operation of the engine, the required oil pressure immediately prevails at the setting unit and thus the valve lash compensating device becomes operative within the shortest delay after engine start.

DESCRIPTION OF THE PREFERRED EMBODIMENTS

Figure 1:
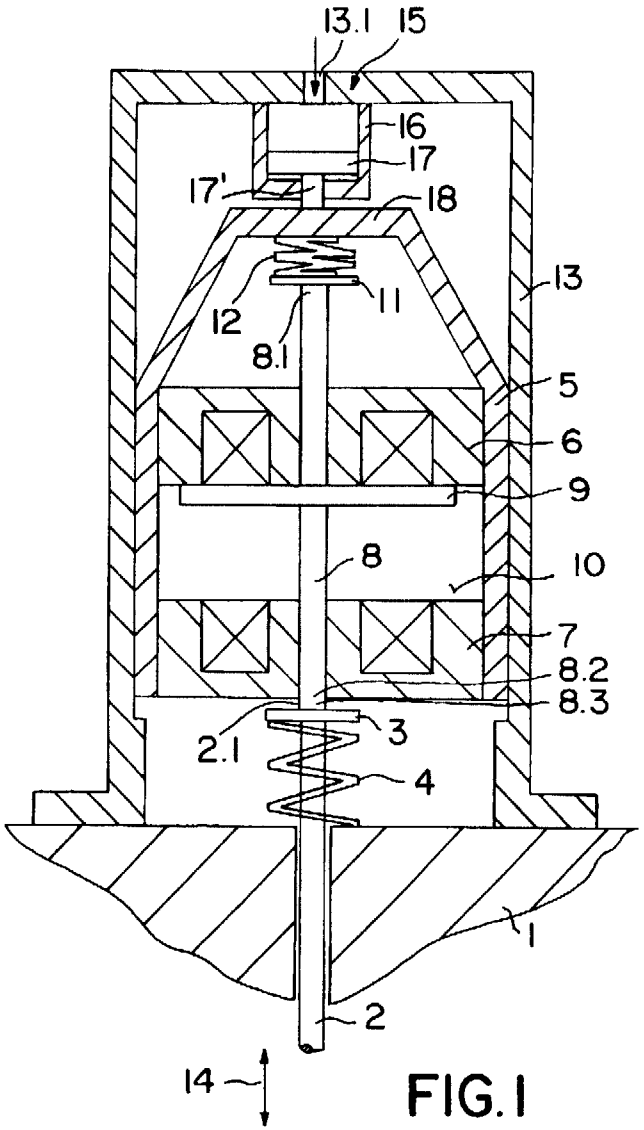
FIG. 1 is an axial sectional view of a preferred embodiment of the invention.

Turning to FIG. 1, in a cylinder head 1 of an internal-combustion engine a cylinder valve (poppet valve) having a stem 2 is slidably supported in a conventional manner. The stem 2 of the cylinder valve is, at its free end, provided with a spring seat disk 3 which supports a return spring 4 exerting a force in the valve-closing direction.

The electromagnetic actuator illustrated in FIG. 1 has a housing 5 receiving an electromagnet 6 operating as a closing magnet and an electromagnet 7 operating as an opening magnet. The two electromagnets 6 and 7 are secured to the housing 5 at a fixed distance from one another. An armature 9 firmly connected with a guide rod 8 is longitudinally slidably supported for reciprocation between two pole faces 10 of the electromagnets 6 and 7. The distance between the two pole faces 10 determines the maximum opening stroke of the valve. The upper end 8.1 of the guide rod 8 is provided with a spring seat disk 11 which supports a second return spring 12, whose opposite end is in engagement with an inner face of the housing 5. With its other end 8.2 the guide rod 8 is in contact with the stem 2 of the cylinder valve. The two return springs 4 and 12 which exert their forces in opposite directions, are designed such that in a deenergized state of the electromagnets 6 and 7 the armature 9 is situated in a mid-position between the two pole faces 10. If, by means of a control device not illustrated in further detail, the two electromagnets 6 and 7 are alternatingly energized, the armature 9, in response to the energization between the two electromagnets 6 and 7, moves back and forth, and, accordingly, the cylinder valve is opened and closed. FIG. 1 shows the system in the "valve closed" position.

The housing 5, together with the two electromagnets 6, 7, the armature 9, and the return spring 12 constitutes a compact, separate structural unit. The housing 5 is slidably received in a guide sleeve 13 for displacements parallel to the direction of valve motion (arrow 14). The guide sleeve 13 is secured to the top face of the cylinder head 1. The housing 5 is set in the guide sleeve 13 in such a manner that the tip 8.3 of the guide rod 8 is seated without any clearance on the free end 2.1 of the valve stem 2.

Further, the guide sleeve 13 supports a setting assembly which, in the present embodiment, is constituted by a piston-and-cylinder unit 15. The cylinder 16 of the unit 15 is affixed to the inner face of the guide sleeve 13, while the piston 17 of the unit 15 contacts, by means of a piston rod 17', an upper end 18 of the housing 5. The piston-and-cylinder unit 15 is, through a port 13.1 provided in the guide sleeve 13, coupled to the pressurized oil supply system of the internal-combustion engine. The oil supply system charges the piston-and-cylinder unit 15 with oil at a pressure of approximately 0.5–1 bar. Since the return force of the return spring 4 is significantly greater than the force exerted by the setting assembly 15 in the opening direction, the housing 5 may be moved in the guide sleeve 13 in the direction of the cylinder valve without displacing the valve stem 2 in the valve-opening direction.

During the opening motion of the cylinder valve, the housing 5 is, as a result of reaction forces, countersupported by the cylinder head 1 with the intermediary of the hydraulic setting unit 15 and the guide sleeve 13. Further, the piston 17 of the setting unit 15 is slightly shifted upwardly. This minimal shift is utilized after the closing motion of the valve for an overall compensation of length changes in the valve operation.

Figure 2:
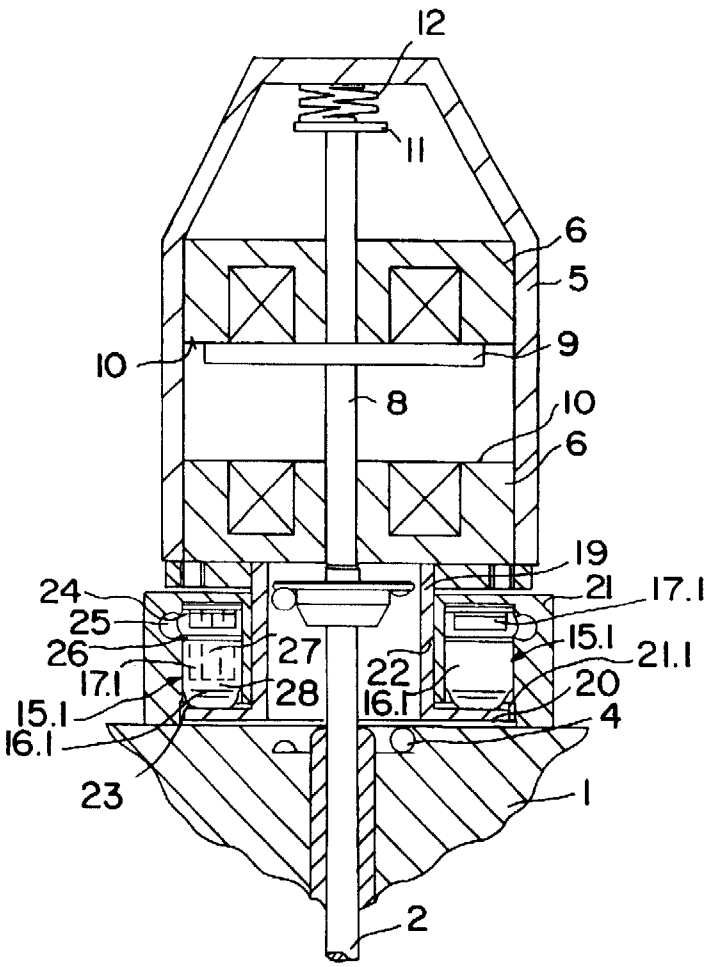
FIG. 2 is an axial sectional view of another preferred embodiment of the invention.

In the embodiment according to FIG. 2 the arrangements which guide the housing 5 and exert a hydraulic force thereto are differently structured.

To the end face of the housing 5 an axially outwardly extending tubular pressing part 19 is affixed which, at its free end, has a terminal, radially outwardly oriented flange 20. An annular holding part 21 is secured to the cylinder head 1 and serves, with its cylindrical inner face 22, as a guiding surface for axial sliding motions of the pressing part 19. On its side oriented towards the cylinder head 1, the holding part 21 has a recess 21.1 into which extends the flange 20 of the pressing part 19.

In the holding part 21 two diametrically opposite receiving bores 23 are provided, into which respective piston-and-cylinder units 15.1 are inserted, each having a piston 17.1 and a cylinder 16.1. The piston 17.1 engages the top base of the respective receiving bore 23, while the cylinder 16.1 is displaceably guided therein and rests on the top face of the flange 20. The piston 17.1 has a throughgoing axial bore 27 which opens into the inner space (chamber) 28 of the cylinder 16.1. The free space 24 of the bore 23 between the cylinder 16.1 and the piston 17.1 is in communication through a port 25 with the pressure fluid supply system of the internal-combustion engine. The free space 24 is charged through the supply bore 25 with pressurized oil which enters through a port 17.2 into the axial bore 27 provided in the piston 17.1 and then into the cylinder chamber 28 where the thus generated pressure exerts an axial separating force to the cylinder 16.1 and the piston 17.1. As a result, the cylinder 16.1 is shifted and shifts the cylinder 16.1, the pressing part 19 and the housing 5 are shifted as a unit until the lower end of the guide rod 8 contacts the upper end of the valve stem 2, or a securing ring 26 carried on the outer surface of the cylinder 16.1 arrives into engagement with the edge of the receiving bore 23 bounding the free space 24. The securing ring 26 serves as a stroke limiting member.

Upon opening the cylinder valve, the housing 5 is lifted by the forces exerted thereon. In order to counteract these forces, in the hydraulic piston-and-cylinder units 15, 15' in the two embodiments shown in FIGS. 1 and 2, a non-illustrated check valve is provided which closes at the beginning of the valve opening stroke and prevents an outflow of the hydraulic fluid. By means of defined tolerances, however, during the opening motion an intentional outflow of the hydraulic liquid is provided so that the system resets itself to a slight extent. At the beginning of the closing stroke the system may thus repeatedly reset itself so that geometrical changes of the valve stem relative to the actuator occurring during operation and caused, for example, by thermal effects or wear, may be compensated for to thus ensure a contact between the guide rod 8 and the valve stem 2.

The annular holding part 21 of the FIG. 2 embodiment may be replaced by a transverse yoke and, dependent on the design and dimensions of the system, a single piston-and-cylinder unit 15.1 as the setting arrangement may suffice. In larger systems two, three or even more piston-and-cylinder units 15.1 may be used as the setting arrangement.

It will be understood that the above description of the present invention is susceptible to various modifications, changes and adaptations, and the same are intended to be comprehended within the meaning and range of equivalents of the appended claims.

What is claimed is:

1. In an internal-combustion engine comprising (a) a cylinder head;

(b) a cylinder valve supported in said cylinder head for reciprocating motion to assume open and closed positions; said cylinder valve having a valve stem;

(c) an electromagnetic actuator for operating said cylinder valve; said electromagnetic actuator including (1) a housing;

(2) a first and a second electromagnet received in said housing and secured thereto at a fixed distance from one another; said first electromagnet having a first pole face and said second electromagnet having a second pole face; said first and second pole faces being oriented toward one another;

(3) an armature positioned between said first and second pole faces for a reciprocating motion therebetween;

(4) return springs being arranged for exerting oppositely oriented forces on said armature, whereby said armature executes the reciprocating motion against a spring force;

(5) connecting means for coupling said armature to said stem of said cylinder valve; and (6) a setting unit for displacing said housing relative to said cylinder valve.

2. The internal-combustion engine as defined in claim 1, wherein said setting unit comprises a piston-and-cylinder unit; further comprising means for introducing pressurized fluid to said piston-and-cylinder unit for energizing said piston-and-cylinder unit.

3. The internal-combustion engine as defined in claim 2, wherein said internal-combustion engine comprises a pressurized oil supply system; said means for introducing pressurized fluid being formed by said pressurized oil supply system.

4. The internal-combustion engine as defined in claim 1, further comprising guide means for guiding said housing for displacements in a direction parallel to said reciprocating motion of said valve.

5. The internal-combustion engine as defined in claim 2, wherein said housing has an end face oriented toward said valve and further wherein said guide means is positioned adjacent said end face.

6. The internal-combustion engine as defined in claim 5, wherein said guide means comprises (a) a holding member affixed to said cylinder head;

(b) a pressing member affixed to said housing and extending therefrom into said holding member; said setting unit being disposed between said pressing member and said holding member to exert a displacing force to said housing through said pressing member.

7. The internal-combustion engine as defined in claim 6, wherein said setting unit comprises a piston-and-cylinder unit accommodated in said holding member.

8. The internal-combustion engine as defined in claim 7, wherein said holding member comprises a bore receiving said piston-and-cylinder unit.

9. The internal-combustion engine as defined in claim 8, wherein said piston-and-cylinder unit includes a piston affixed to said pressing member and a cylinder affixed to said holding member; said piston extending into said cylinder and being slidable therein relative thereto; further comprising means for introducing pressurized fluid into said bore for exerting a force on said cylinder in a direction parallel to said reciprocating motion of said valve.

10. The internal-combustion engine as defined in claim 9, wherein said internal-combustion engine comprises a pressurized oil supply system; said means for introducing pressurized fluid being formed by said pressurized oil supply system.

11. The internal-combustion engine as defined in claim 4, wherein said guide means comprises a guide sleeve affixed to said cylinder head; said guide sleeve having an interior accommodating said housing.

* * * * *